US006956447B2

(12) United States Patent
Lee et al.

(10) Patent No.: US 6,956,447 B2
(45) Date of Patent: Oct. 18, 2005

(54) DIRECTIONAL COUPLER USING NON-RADIATIVE DIELECTRIC WAVEGUIDE

(75) Inventors: Hong Yeol Lee, Cheongju-Shi (KR); Jin Woo Hahn, Daejon-Shi (KR); Dong Suk Jun, Daejon-Shi (KR); Kyoung Suk Ko, Cheongju-Shi (KR); Sang Seok Lee, Daejon-Shi (KR)

(73) Assignee: Electronics and Telecommunications Research Institute (KR)

( * ) Notice: Subject to any disclaimer, the term of this patent is extended or adjusted under 35 U.S.C. 154(b) by 68 days.

(21) Appl. No.: 10/682,628

(22) Filed: Oct. 8, 2003

(65) Prior Publication Data

US 2004/0130409 A1 Jul. 8, 2004

(30) Foreign Application Priority Data

Dec. 18, 2002 (KR) ..... 10-2002-0081476

(51) Int. Cl.[7] ..... H01P 5/18; H01P 1/08
(52) U.S. Cl. ..... 333/113; 333/208; 333/248
(58) Field of Search ..... 333/109, 113, 333/116, 208, 212, 239, 248

(56) References Cited

U.S. PATENT DOCUMENTS 6,147,569 A 11/2000 Kishino et al.
6,163,227 A * 12/2000 Saitoh et al. ..... 331/117 D
6,172,648 B1 1/2001 Tanizaki et al.
6,486,753 B1 * 11/2002 Kim ..... 333/208
6,832,081 B1 * 12/2004 Hiramatsu et al. ..... 455/328

FOREIGN PATENT DOCUMENTS

| | | | | |
|---|---|---|---|---|
| JP | 08-162813 | | 6/1996 | |
| JP | 8-162813 A | * | 6/1996 | ..... H01P/5/18 |
| JP | 2000-022412 | | 1/2000 | |
| KR | 1998-3279 | | 3/2001 | |
| WO | WO 02/067368 A1 | * | 8/2002 | ..... H01P/5/18 |

OTHER PUBLICATIONS

Tsukasa Yoneyama, et al.; "Coupling Chracteristics of Non-radiative Dielectric Waveguides" IEEE Transactions on Microwave Theory and Techniques, vol. MTT–31, No. 8, Aug. 1983, pp. 648–654.

* cited by examiner

*Primary Examiner*—Dean Takaoka
(74) *Attorney, Agent, or Firm*—Blakely Sokoloff Taylor & Zafman

(57) ABSTRACT

A dictionary coupler using a non-radiative dielectric waveguide is disclosed. Particularly, a millimeter wave band non-radiative dielectric waveguide directional coupler using a multiple-hole structure in which two parallel NRD waveguides located between upper and lower conductive plates and a conductive plate having a multiple-hole structure is inserted between two NRD waveguides to couple electric and magnetic waves of an electric field component or a magnetic field component is provided.

11 Claims, 9 Drawing Sheets

DIRECTIONAL COUPLER USING NON-RADIATIVE DIELECTRIC WAVEGUIDE

BACKGROUND OF THE INVENTION

1. Field of the Invention

The present invention relates to a directional coupler using a non-radiative dielectric (NRD) waveguide, and more particularly, to a millimeter wave band non-radiative dielectric waveguide directional coupler using a multiple-hole structure in which two parallel NRD waveguides is located between upper and lower conductive plates and a conductive plate having a multiple-hole structure is inserted between two NRD waveguides to each other to couple electric and magnetic waves of an electric field component or a magnetic field component. This is mainly used in a RF (radio frequency) circuit of the millimeter wave band wireless communication system.

2. Description of the Prior Art

In the conventional directional coupler using the NRD waveguide, a method of determining the coupling ratio by adjusting the distance between two NRD waveguides is often used. As such method, there are three methods. A first method is a method of adjusting the coupling ratio by positioning two NRD waveguides having straight line shape and parallel to each other between the upper and lower conductive plates to adjust the distance between two NRD waveguides. A second method is a method of adjusting the coupling ratio by positioning two NRD waveguides bended with a predetermined curvature radius between the upper and lower conductive plates to adjust the distance between the two NRD waveguides. A third method is a method of adjusting the coupling ratio by positioning a NRD waveguide having a straight line shape and a NRD waveguide bended with a predetermined curvature radius between the upper and lower conductive plates to adjust the distance between the two NRD waveguides.

The conventional the directional coupler using the NRD waveguide mostly uses a coupling method for adjusting the distance between the two NRD waveguides. The directional coupler using this coupling method has a merit that the structure thereof is simple various coupling ratios can be implemented. However, it is difficult to fix the location for maintaining the adjusted distance, and it is difficult to reproduce it because the coupling distance is adjusted so as to have a desired coupled amount for each manufacture thereof, thereby it is difficult to adjust an accurate coupling ratio, and the curvature loss is generated in case of the directional coupler using the bended NRD waveguide.

On the other hand, beside the conventional directional coupler for determining the coupling ratio by adjusting the distance between two NRD waveguides, there is a branch-line coupler using the NRD waveguide. This is 3 dB directional coupler designed such that a series arm having an of $(\frac{1}{2})^{1/2}$ impedance of a characteristic impedance and a ¼ length of a guided wavelength ($\lambda g$) and a parallel arm having an impedance equal to the characteristic impedance and a ¼ length of $\lambda g$ are arranged to output 3 dB of the half size of the input signal to a through port and a coupled port and the phase shift between two ports becomes 90 degree.

In case of the branch-line coupler using the NRD waveguide, there are advantages that it is easy to fix the location and the reproduction thereof is good. But, it is difficult to implement various coupling ratios, because only the 3 dB coupler can be implemented according to the characteristics of the coupler.

SUMMARY OF THE INVENTION

Thus, in order to solve the problems of the prior art, the object of the present invention is to provide a new type millimeter wave band NRD waveguide directional coupler which the location thereof is easily fixed, the reproduction thereof is good, various accurate coupling ratios can be implemented, and a wide band characteristic is accomplished in the directional coupler using the NRD waveguide, by using the coupling method different from the prior art.

According to the present invention, a directional coupler using a non-radiative dielectric waveguide, comprising upper and lower conductive plates having conductive planes opposite to and substantially parallel to each other and; a first NRD waveguide and a second NRD waveguide formed between the conductive plates and composed of dielectric having a predetermined permittivity; and a multiple-hole conductive plate formed between the first NRD waveguide and the second NRD waveguide and having at least one through-hole, wherein the electric field component or the magnetic field component in the transmission mode of the NRD waveguides is coupled through the through-hole formed in the multiple-hole conductive plates is provided.

On the other hand, there are various kinds of the first NRD waveguide and the second NRD waveguide, the first NRD waveguide and the second NRD waveguide are hyper NRD waveguides or normal NRD waveguides. In addition, the upper and lower conductive plates and the multiple-hole conductive plate may be perpendicular to each other or may be parallel to each other.

Further, the through-holes of the multiple-hole conductive plate may be two rows of circular holes, and it is preferable that the distance between the circular holes in a row is $\lambda g/4$.

The signal transmitted through the NRD waveguide may be a millimeter wave band signal, and the coupled amount of the directional coupler may be 20 dB, 10 dB, or 3 dB.

DESCRIPTION OF THE PREFERRED EMBODIMENTS

Hereinafter, the millimeter wave band non-radiative dielectric waveguide directional coupler using the multiple holes according to the preferred embodiments of the present invention will be explained with reference to the accompanying drawings. However, the embodiment of the present invention can be changed into a various type, and it should be not understood that the scope of the present invention is limit to the following embodiments. The embodiments of the present invention are provided in order to explain the present invention to those skilled in the art. On the other hand, like numerals present like elements throughout the several figures and the explanation of the repeated element will be omitted.

First Embodiment

Hereinafter, the directional coupler according to a first embodiment of the present invention will be explained with reference to FIGS. 1 to 4 in detail.

Figure 1:
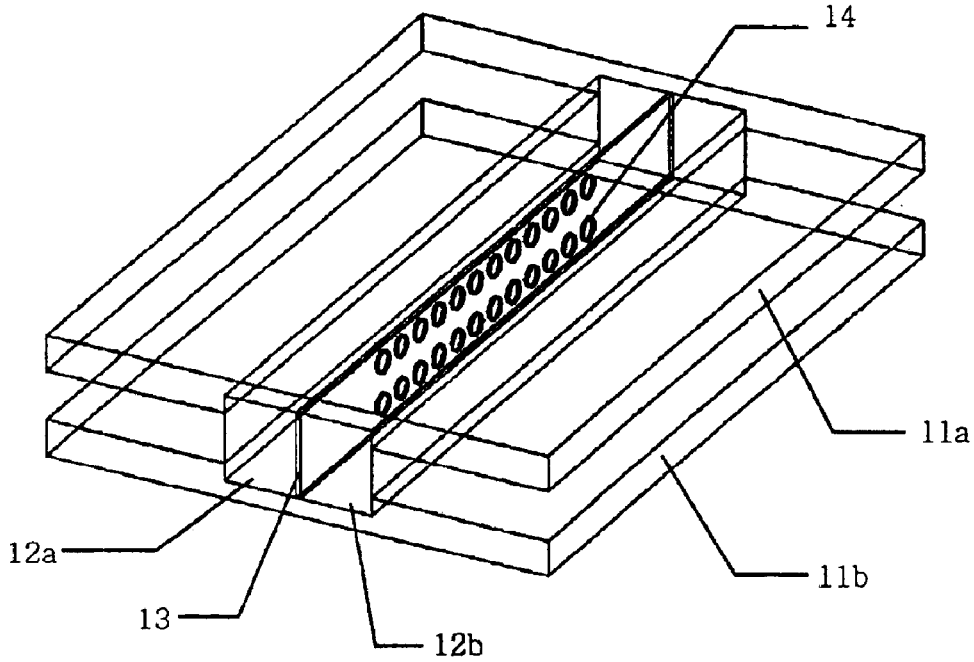
FIG. 1 is a structural diagram of a directional coupler according to a first embodiment of the present invention.
Figure 2:
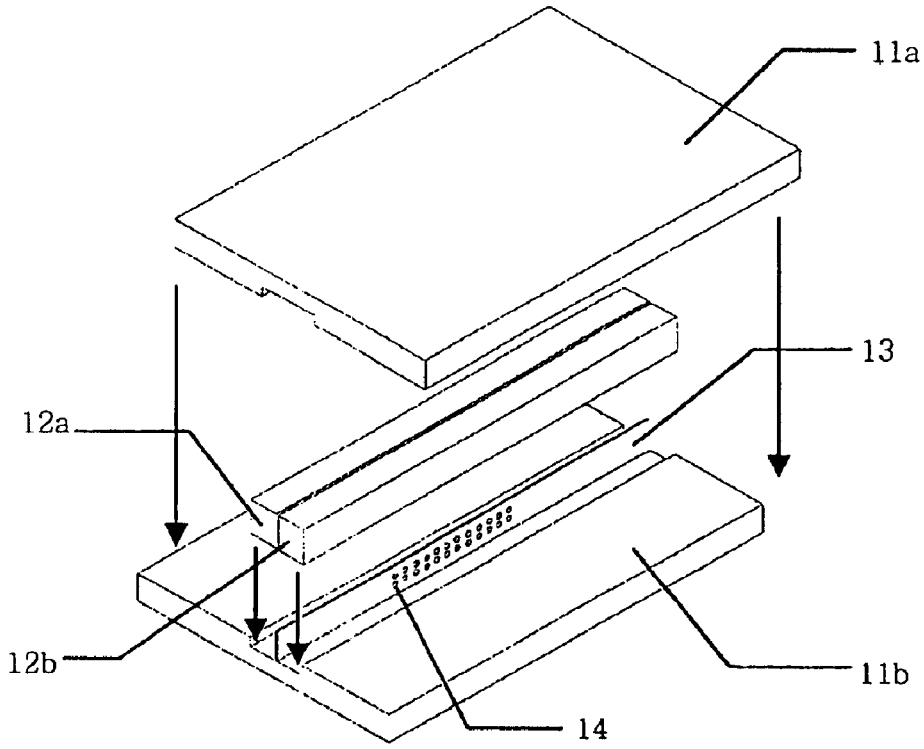
FIG. 2 is an exploded perspective view of the directional coupler in FIG. 1.
Figure 3A:
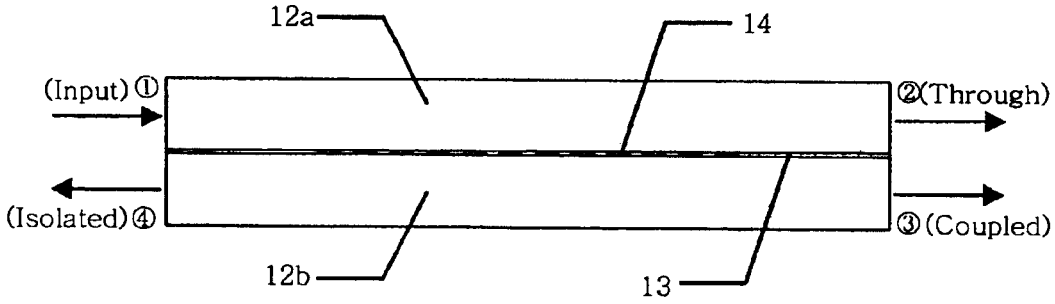
FIGS. 3A to 3D are a plan view, a front view, a side view, and an enlarged view for illustrating the structure and the function of the directional coupler in FIG. 1, respectively.
Figure 3B:
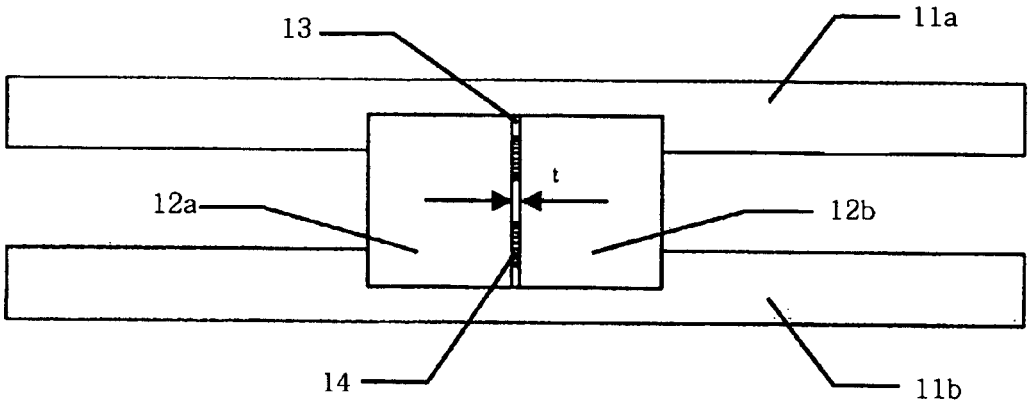
Figure 3C:
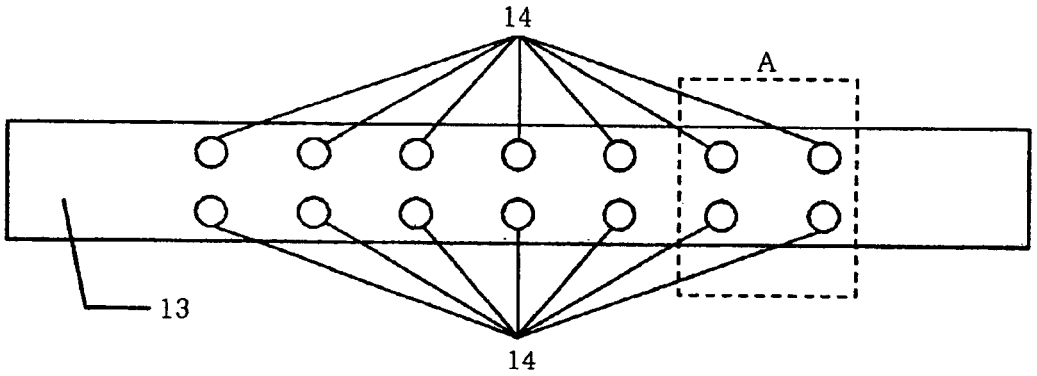
Figure 3D:
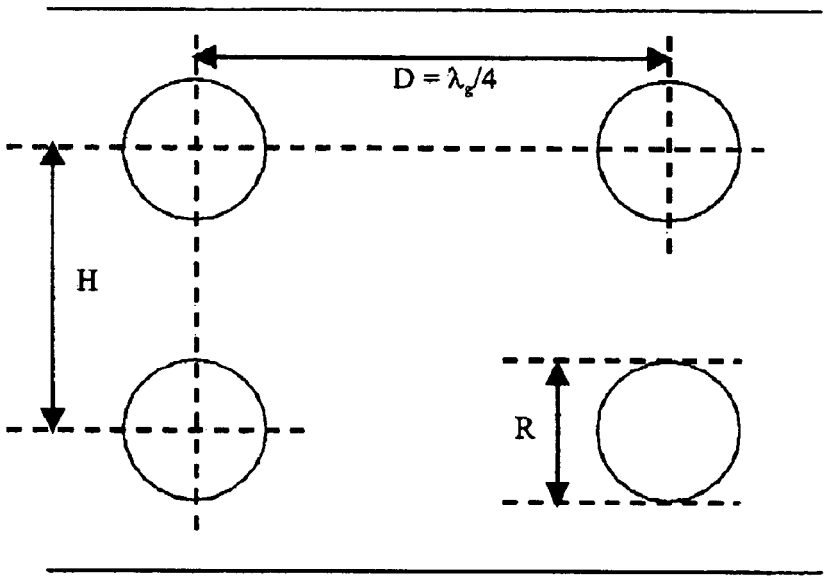

FIG. 1 is a structural diagram of a directional coupler according to a first embodiment of the present invention, FIG. 3A is a plan view for illustrating the structure and the function of the directional coupler using the NRD waveguide in FIG. 1, FIG. 3B is a front view of the directional coupler in FIG. 1, FIG. 3C is a side view of the directional coupler in FIG. 1, FIG. 3D is an enlarged partial view of A portion shown by a dotted line in FIG. 3C, and FIG. 2 is an exploded perspective view.

Referring to FIG. 1, the directional coupler comprises an upper conductive plate 11*a* and a lower conductive plate 11*b* having conductive metallic component material, a first NRD waveguide 12*a* and a second NRD waveguide 12*b* composed of dielectric material parallel to each other having any permittivity and located between the upper and lower conductive plates, and a multiple-hole conductive plate 13 inserted between the two NRD waveguides 12*a*, 12*b*, having the metallic component material and including multiple holes 14 penetrated therethrough. FIG. 2 is the exploded perspective view of FIG. 1, and the coupling relationship between the elements in FIG. 1 can be understood by FIG. 2.

The first and second NRD waveguides 12*a*, 12*b* are the Hyper NRD waveguides, and couples the electric field component of a LSM (Longitudinal Section Magnetic) mode that is the transmission mode of the NRD waveguide or the magnetic field component of a LSE (Longitudinal Section Electric) mode.

In the HNRD waveguide, grooves are formed in both surfaces of the upper and lower conductive plates 11*a*, 11*b* and the NRD waveguides 12*a*, 12*b* are inserted between these grooves.

FIG. 3A is a plan view enlarging only the dielectric NRD waveguides 12*a*, 12*b* including the multiple-hole conductive plate 13 in order to explain the structure and the function of the directional coupler using the NRD waveguide shown in FIG. 1. In the two parallel NRD waveguides 12*a*, 12*b* composed of the dielectric having any permittivity, the radio wave incident to a (1) input port is progressed along with the first NRD waveguide 12*a*, and the radio wave having a certain coupling ratio is output at a (2) through port in the first NRD waveguide 12*a* and a (3) coupling port in the second NRD waveguide 12*b*, by the structure of the multiple-hole conductive plate 13 composed of metallic material, including the multiple holes 14, and located between the first NRD waveguide 12*a* and the second NRD waveguide 12*b*. At this time, the coupling ratio is determined by the structure of the multiple holes 14 included in the multiple-hole conductive plate 13. A (4) isolated port hardly generates the output by adjusting the distance of the structure of the multiple holes 14.

FIG. 3B is a front view of the directional coupler shown in FIG. 1. The two parallel NRD waveguides 12*a*, 12*b* is arranged between the upper conductive plate 11*a* and the lower conductive plate 11*b* having the HNRD waveguide structure, the multiple-hole conductive plate 13 located between the first NRD waveguide 12*a* and the second NRD waveguide 12*b* composed of the metallic component material, having a thickness (t), and including the multiple holes 14.

FIG. 3C is a side view of the multiple-hole conductive plate 13 of the directional coupler shown in FIG. 1. The multiple-hole conductive plate 13 comprises multiple holes 14 arranged in a double line. The multiple-hole conductive plate 13 is composed of the metallic component material.

FIG. 3D is an enlarged view of the portion A shown by a dotted line in FIG. 3C. The detail structure of the multiple holes can be expressed by an distance (D) between the multiple holes arranged in the progressed direction of the radio wave, an distance (H) between the multiple holes arranged in the direction perpendicular to the progressed direction of the radio wave, and the diameter of the hole. It can be designed such that the distance (D) between the multiple holes arranged in the progressed direction of the radio wave becomes $\lambda g/4$. In this case, each value is not limited and can be varied as needed. For example, the distance (D) between the multiple holes is about 1 mm, the distance (H) between the multiple holes is 1.2 mm, the diameter of the hole is 0.6 to 0.9 mm, the number of the coupling holes is 12 to 19 in each of the double line, and the thickness of the multiple-hole conductive plate 13 is 0.1 mm.

Hereinafter, the operational principle of the directional coupler according to a first embodiment of the present invention will explained with reference to FIGS. 3A to 3D.

As shown in FIG. 3A, the radio wave is incident to the first NRD waveguide 12*a*, and the multiple holes 14 located in the multiple-hole conductive plate 13 are formed in the vertical direction of the radio wave. Accordingly, when the radio wave is progressed from the left side to the right side in FIG. 3D, supposed that the first hole among the multiple holes is considered as the reference of the phase and the next hole is a coupled structure in the multiple hole structure arranged in the direction perpendicular to the progressed direction of the radio wave of the right side, most of the radio wave is progressed to the through port along with the first NRD waveguide 12*a*, and the remaining radio wave is coupled to the second NRD waveguide 12*b* by the reference hole to be progressed to the coupled port. Since the radio wave progressed in the first NRD waveguide 12*a* has the phase of 90 degree in the coupled structure arranged at the location next to the reference, and the radio wave coupled to the second NRD waveguide 12*b* at the reference and progressed to the coupled port (3) has the phase of 90 degree at the coupled structure (Q) located next to the reference, the phases of the incident radio wave and the radio waves at the through port (2) and the coupled port (3) become 90 degree, that is, in-phase.

On the contrary, since, in the coupled structure immediately next to the reference, the radio wave gone back in the reverse direction of the progressed direction of the radio wave has the phase of $\lambda g/2$ at the reference, he phases of the radio waves coupled at the reference are 0 degree and 180 degree to be cancelled from each other, the radio wave progressed to the isolated port (4) is not generated. This becomes an important element in the frequency stability and the directivity.

Hereinafter, the actual simulation result of the above-mentioned directional coupler will be explained with reference to FIGS. 4A to 4D. As a simulation tool, HFSS (High Frequency Structure Simulator) of Ansoft corporation is used, and the simulation is performed, while varying the thickness (t) of the multiple-hole conductive plate (13), the distance (D) between the multiple holes, the distance (H) between the multiple holes, the diameter (R) of the hole, and the number of the multiple hole.

Figure 4A:
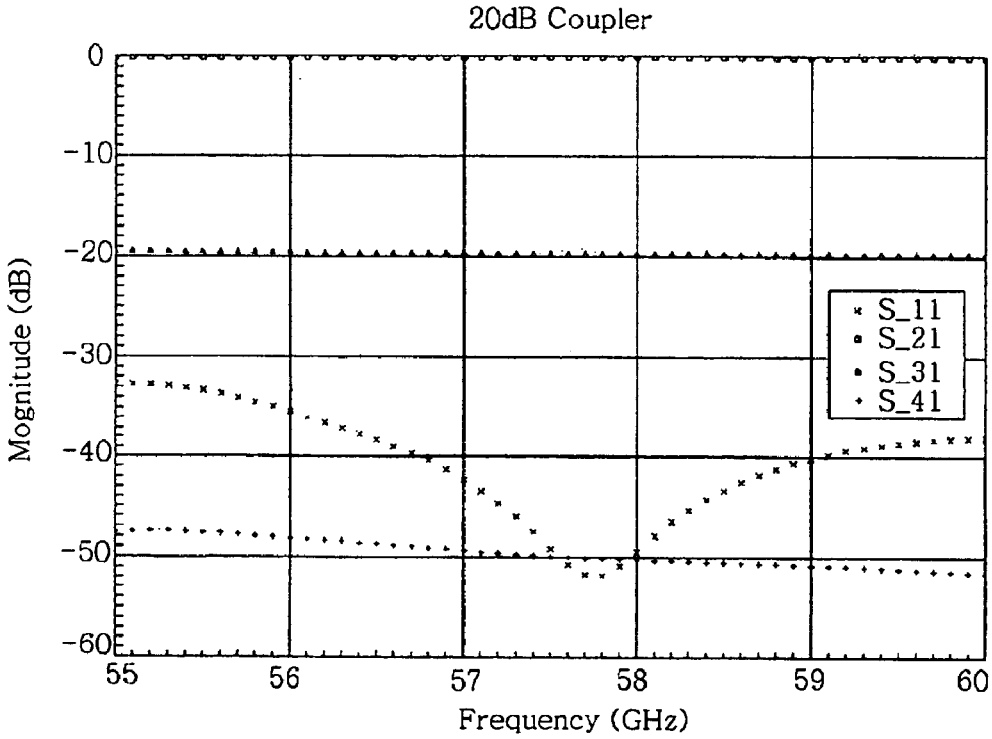
FIGS. 4A to 4D are graphs for illustrating actual simulated results of the directional coupler according to the first embodiment of the present invention.

The first simulation for the directional coupler manufactured such that the coupled amount becomes 20 dB by coupling the electric field component of the LSM (Longitudinal Section Magnetic) mode that is the transmission mode of the NRD waveguide was performed under condition that t=0.1 mm, D=1.0 mm, H=1.2 mm, R=0.6 mm, and the number of the coupling holes is 12*2 rows. At the result, the frequency transfer characteristic is shown in FIG. 4A. In FIG. 4A, S_11 is a return loss, S_21 is an insertion loss, S_31 is a coupled characteristic, and S_41 is an isolated characteristic. It is found that the frequency band is 55 GHz–60 GHz, the coupled amount becomes a very smooth value at 20 dB when the bandwidth is 5 GHz, and the return loss and the isolated characteristic are excellent.

Figure 4B:
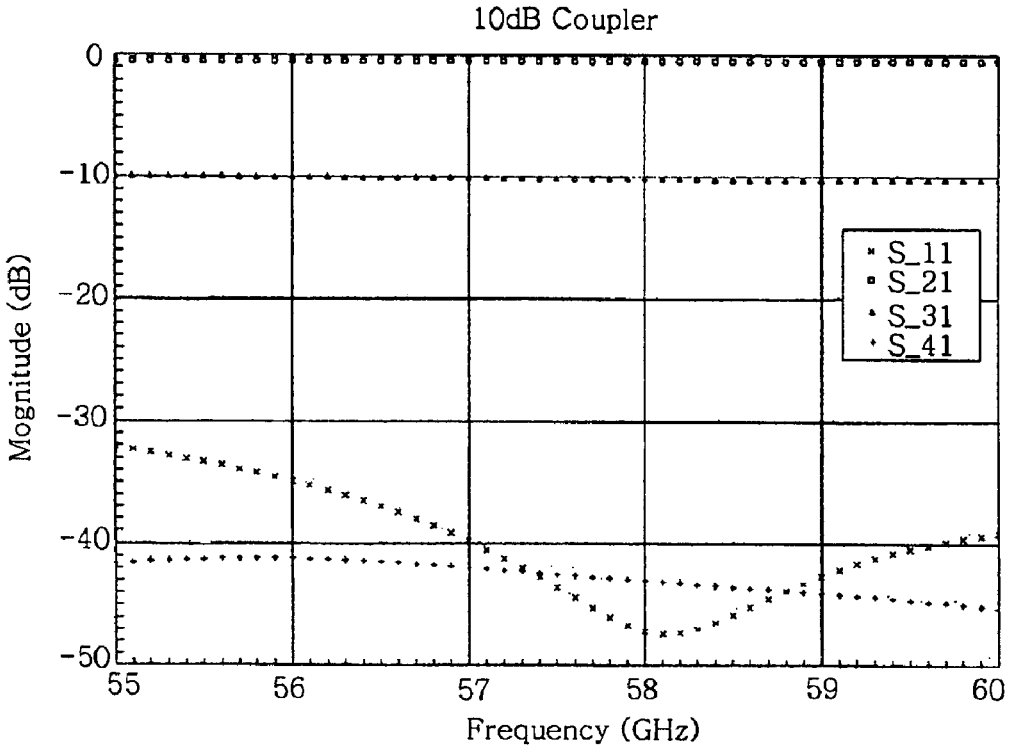

The second simulation for the directional coupler manufactured such that the coupled amount becomes 10 dB by coupling the electric field component of the LSM mode of the transmission mode of the NRD waveguide was performed under condition that t=0.1 mm, D=1.0 mm, H=1.2 mm, R=0.8 mm, and the number of the coupling holes is 12*2 rows. At the result, the frequency transfer characteristic is shown in FIG. 4B. In FIG. 4B, S_11 is a return loss, S_21 is an insertion loss, S_31 is a coupled characteristic, and S_41 is an isolated characteristic. It is found that the frequency band is 55 GHz–60 GHz, the coupled amount becomes a very smooth value at 10 dB when the bandwidth is 5 GHz, and the return loss and the isolated characteristic are excellent.

Figure 4C:
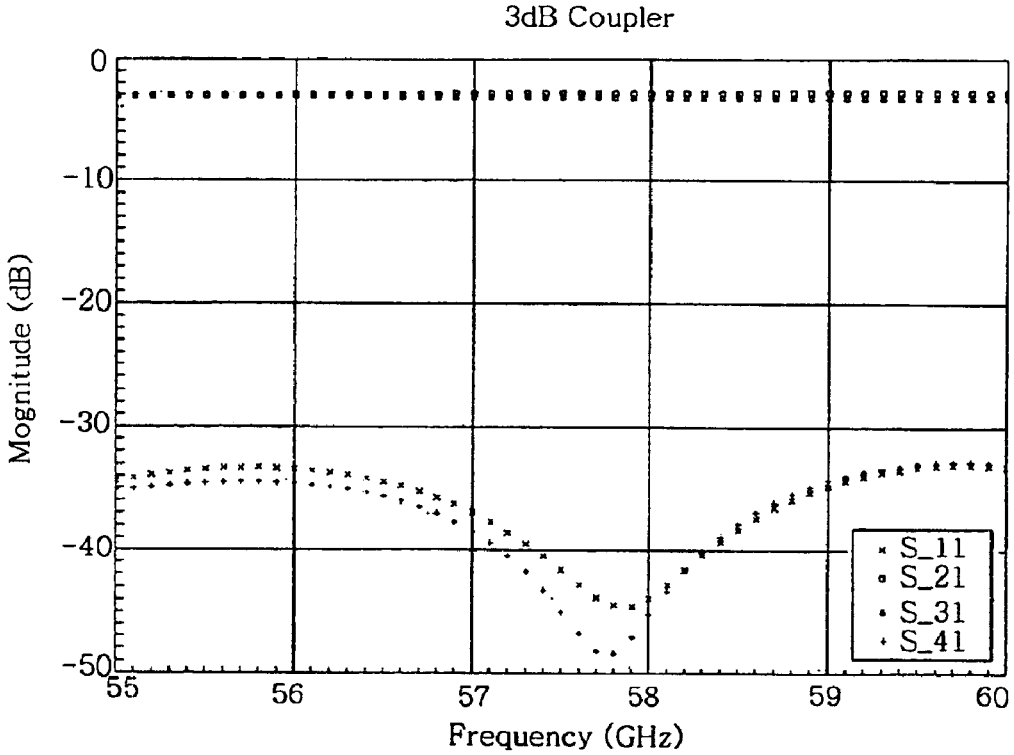

The third simulation for the directional coupler manufactured such that the coupled amount becomes 3 dB by coupling the electric field component of the LSM mode of the transmission mode of the NRD waveguide was performed under condition that t=0.1 mm, D=1.0 mm, H=1.2 mm, R=0.9 mm, and the number of the coupling holes is 19*2 rows. At the result, the frequency transfer characteristic is shown in FIG. 4C. In FIG. 4C, S_11 is a return loss, S_21 is an insertion loss, S_31 is a coupled characteristic, and S_41 is an isolated characteristic. It is found that the frequency band is 55 GHz–60 GHz, the coupled amount becomes a very smooth value at 3 dB when the bandwidth is 5 GHz, and the return loss and the isolated characteristic are excellent.

Figure 4D:
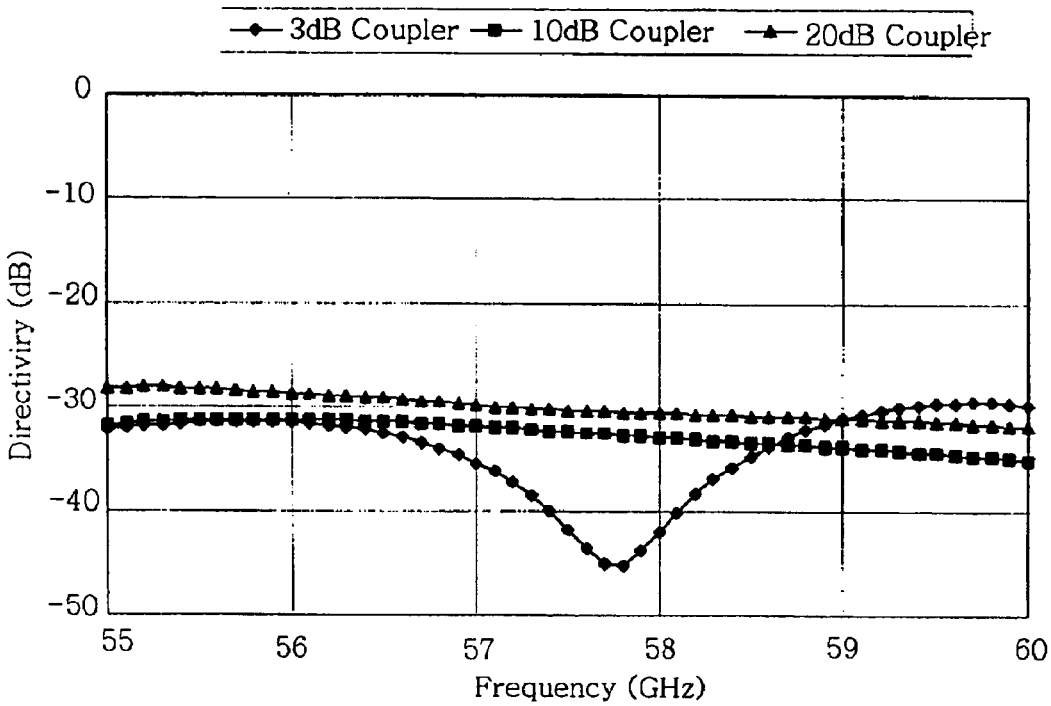

Next, FIG. 4D shows the directivity derived by calculating the frequency transfer characteristic curve of the simulations of the directional couplers manufactured such that the coupled amounts become 20 dB, 10 dB, and 3 dB, respectively, by coupling the electric field component of the LSM mode that is the transmission mode of the NRD waveguide. It is found that the three directional couplers have excellent directional characteristics of about 30 dB.

Second Embodiment

Figure 5:
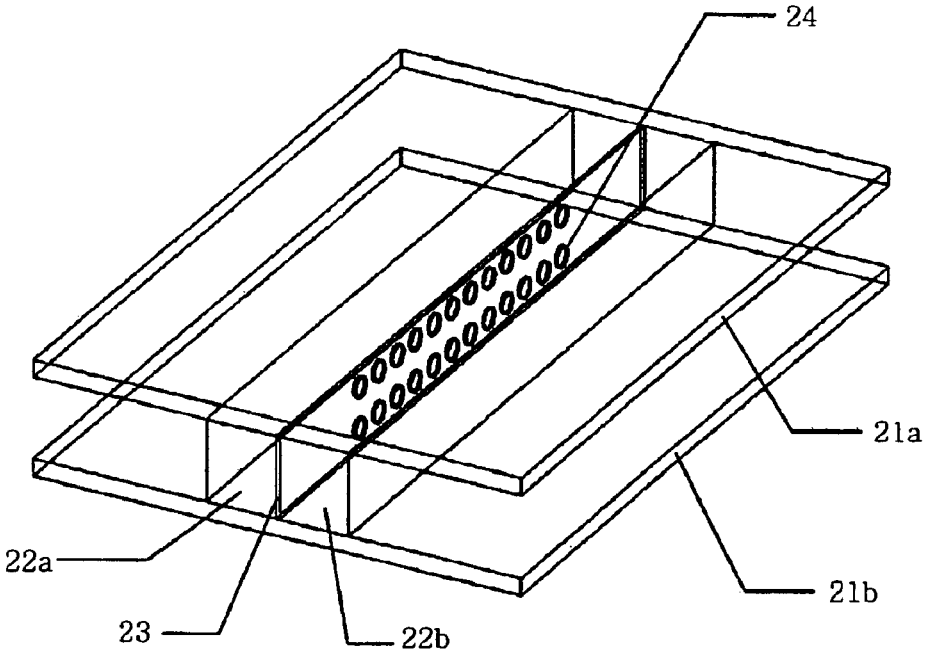
FIG. 5 is the structural diagram of the directional coupler according to a second embodiment of the present invention.

Hereinafter, the directional coupler according to the second embodiment the present invention will be explained with reference to FIG. 5. But, for convenience of the explanation, the second embodiment will be explained based on the difference with the first embodiment. The second embodiment is different from the first embodiment in that the first and second waveguides 22*a*, 22*b* are composed of normal waveguides. That is, in case of the hyper NRD waveguide of the first embodiment, the grooves are formed between the upper and lower conductive plates, and the hyper NRD waveguide is inserted therebetween. However, in case of the normal waveguide according to the second embodiment, the grooves are not formed between the upper conductive plate 21*a* and the lower conductive plate 21*b* (See FIG. 5).

Third Embodiment

Figure 6:
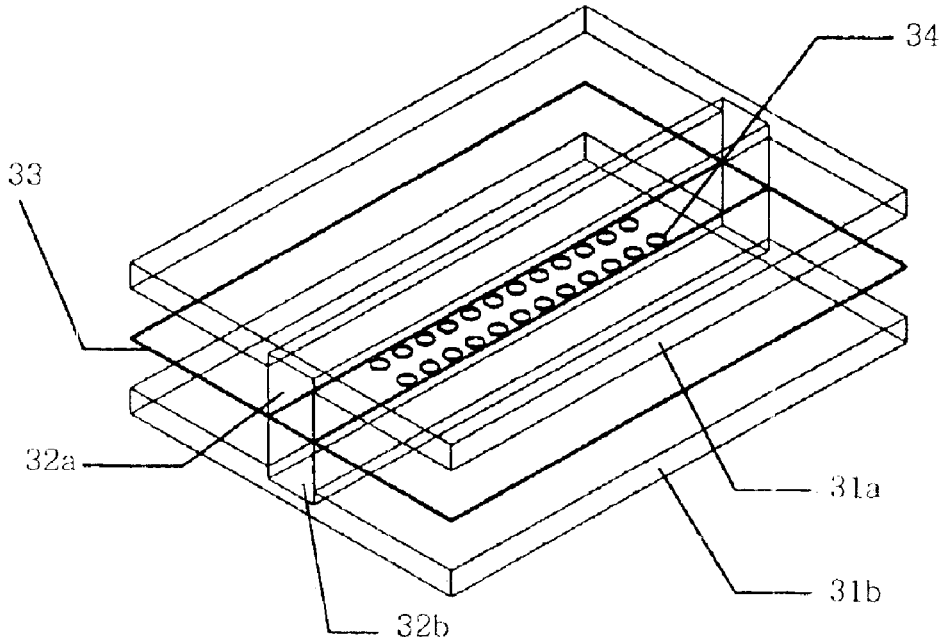
FIG. 6 is the structural diagram of the directional coupler according to a third embodiment of the present invention.

Hereinafter, the directional coupler according to the third embodiment of the present invention will be explained with reference to FIG. 6. But, for convenience of the explanation, the third embodiment will be explained based on the difference with the first embodiment. The third embodiment is similar to the first embodiment in that the first and second waveguides 32*a*, 32*b* is composed of the hyper NRD waveguides. However, in the first embodiment, the upper and lower conductive plates and the multiple-hole conductive plate are perpendicular to each other, while, in the third embodiment, the upper and lower conductive plates 31*a*, 31*b* and the multiple-hole conductive plate 33 are parallel to each other (See FIG. 6).

Fourth Embodiment

Figure 7:
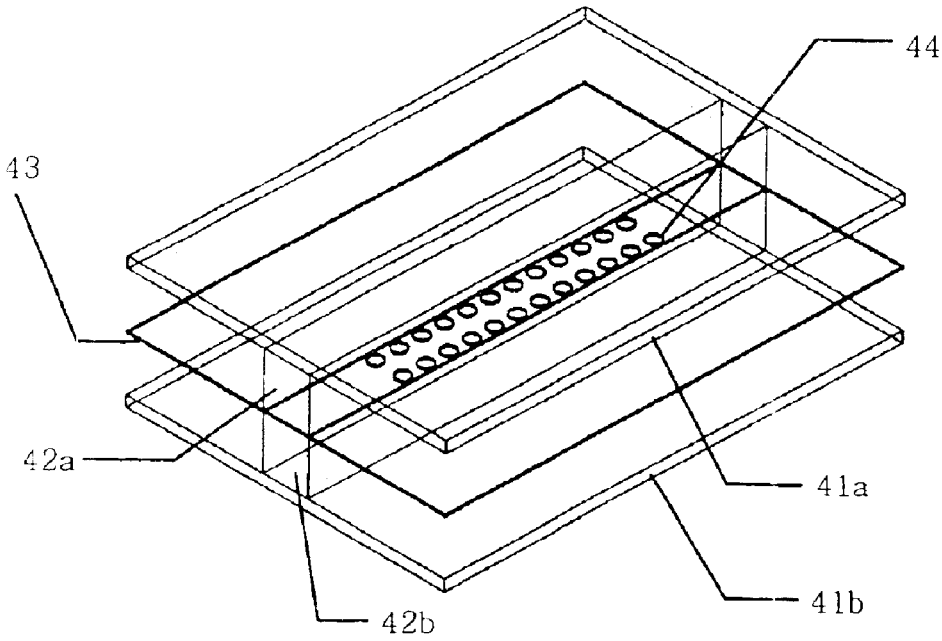
FIG. 7 is the structural diagram of the directional coupler according to a fourth embodiment of the present invention.

Hereinafter, the directional coupler according to the fourth embodiment of the present invention will be explained with reference to FIG. 7. But, for convenience of the explanation, the fourth embodiment will be explained based on the difference with the first embodiment. The fourth embodiment is different from the first embodiment in that the upper and lower waveguides 42*a*, 42*b* are composed of the normal waveguides. In addition, in the first embodiment, the upper and lower conductive plates and the multiple-hole conductive plate are perpendicular to each other, while, in the fourth embodiment, the upper and lower conductive plates 41*a*, 41*b* and the multiple-hole conductive plate 43 are parallel to each other (See FIG. 7)

Figure 8A:
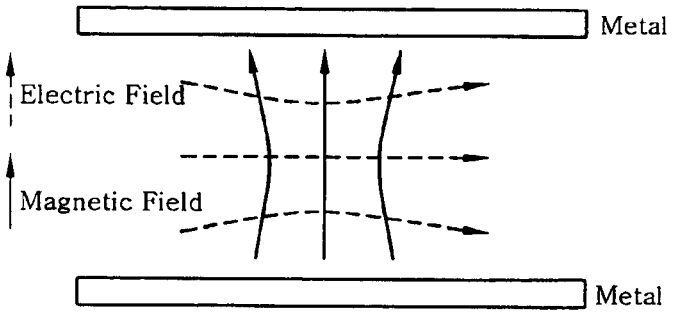
FIG. 8A is a concept diagram for illustrating a coupling principle of a LSM mode in the present invention.
Figure 8B:
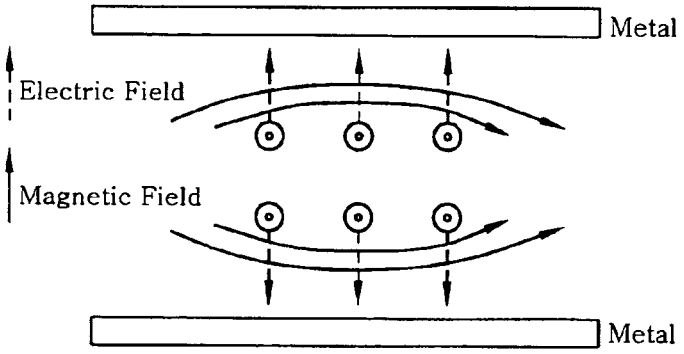
FIG. 8B is a concept diagram for illustrating a coupling principle of a LSE mode.

Hereinafter, the principle of coupling the electric field or the magnetic field by the first to fourth embodiments will be with reference to FIGS. 8A and 8B in detail. FIG. 8A is a concept diagram illustrating the coupling principle of the LSM mode, and FIG. 8B is a concept diagram illustrating of the coupling principle of the LSE mode.

First, according to the first and second embodiments, since the upper and lower conductive plates and the multiple-hole conductive plate are perpendicular to each other and two NRD waveguides are located on both sides of the multiple-hole conductive plate, the structure capable of coupling the electric field component of the LSM mode (FIG. 8A) or the magnetic field component of the LSE mode (FIG. 8B) is accomplished.

On the other hand, in the third embodiment, the upper and lower conductive plates and the multiple-hole conductive plate are parallel to each other and the two NRD waveguides are located on and under the multiple-hole conductive plate. Accordingly, since the NRD waveguide has necessarily metallic conductive plates at the upper and lower portions thereof, in the NRD waveguides are overlapped like the third embodiment, the metallic conductive plates serve as the upper and lower conductive plates (the NRD waveguide located at the upper portion thereof is the lower conductive plate and the NRD waveguide located at the lower portion thereof is the upper conductive plate). Accordingly, the structure capable of coupling the magnetic field of the LSM mode or the electric field of the LSE mode is accomplished. The coupling aspect of the third embodiment is equal to that in the fourth embodiment.

Variation

Figure 9A:
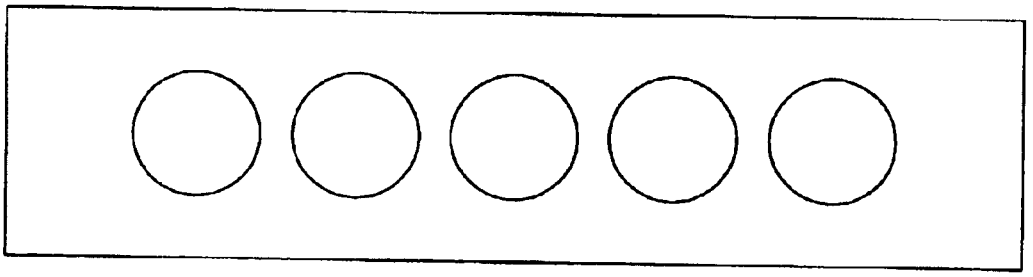
FIGS. 9A to 9I show various shapes of the through-hole of the directional coupler.
Figure 9B:
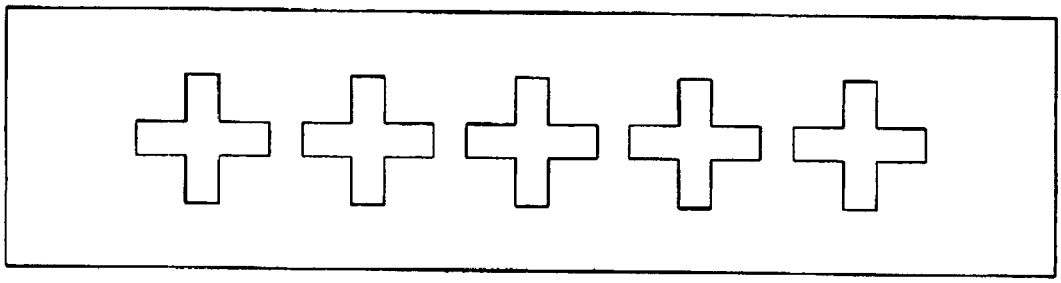
Figure 9C:
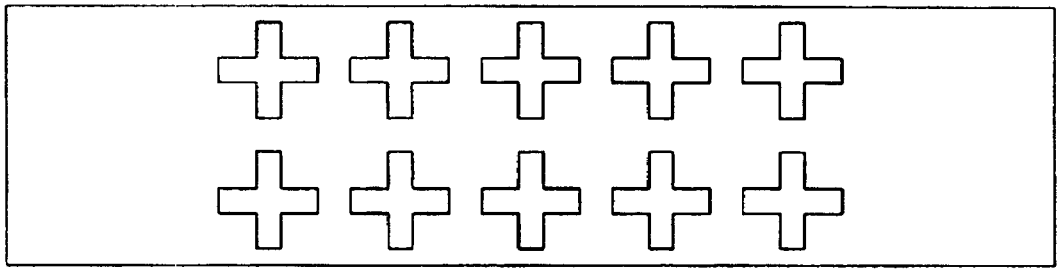
Figure 9D:
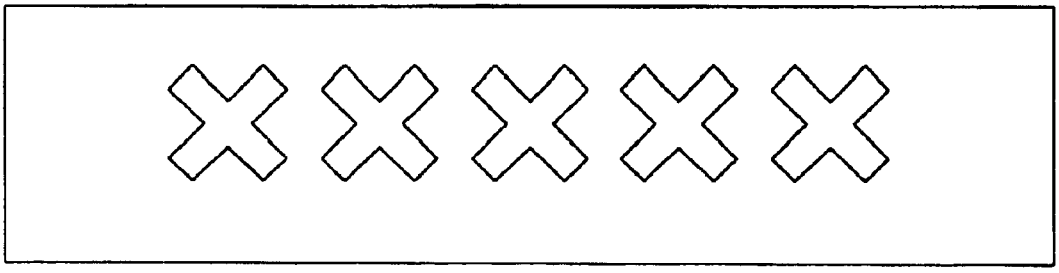
Figure 9E:
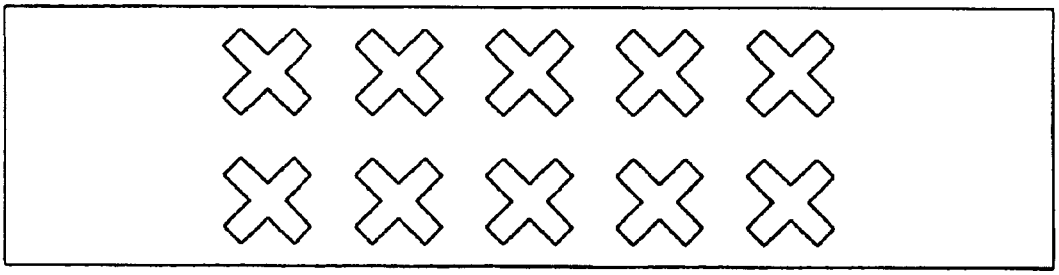
Figure 9F:
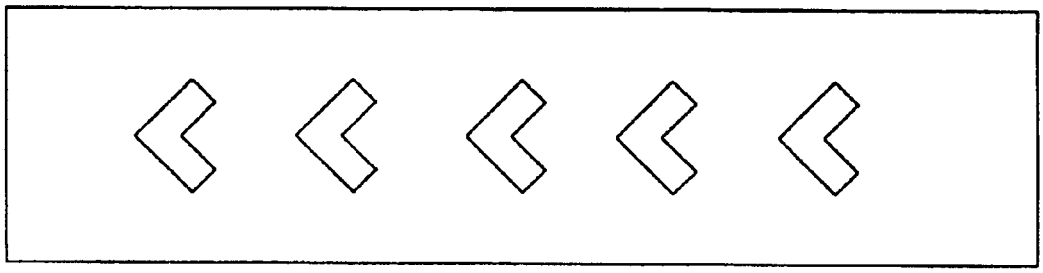
Figure 9G:
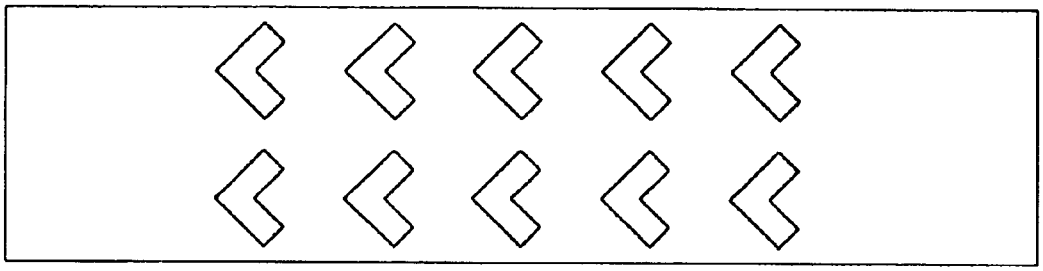
Figure 9H:
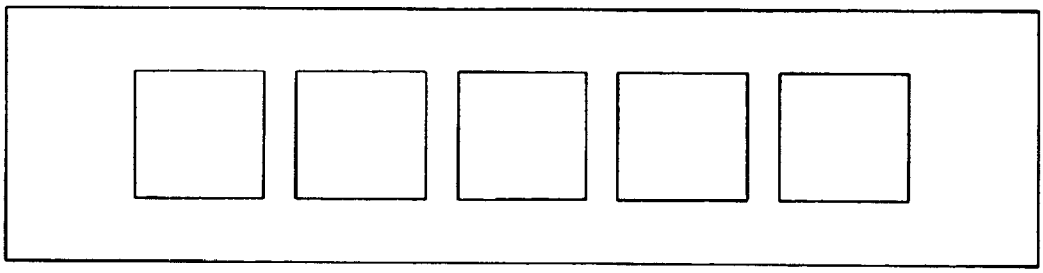
Figure 9I:
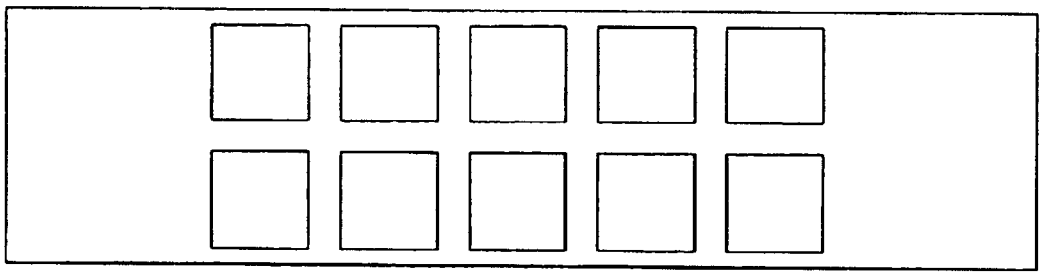

On the other hand, in addition to directional couplers according to the first to fourth embodiments, various variations of the present invention can be implement. That is, if the holes are formed between the first waveguide and the second waveguide, the shape of the hole is not limited. FIGS. 9A to 9I show the various shapes of the hole. There are one row of the holes (FIG. 9A), one row of cross-shaped holes (FIG. 9B), two rows of cross-shaped holes (FIG. 9C), one row of x-shaped holes (FIG. 9E), two rows of x-shaped holes (FIG. 9D), one row of <-shaped holes (FIG. 9F), two rows of <-shaped holes (FIG. 9G), one row of rectangular holes (FIG. 9H), and two rows of rectangular holes (FIG. 9I).

As mentioned above, the present invention can accomplish accurate and various coupling ratios with good reproducibility and can implement the directional coupler satisfying the wide band characteristic without curvature loss, because the location can be easily fixed by solving various problems generated in the characteristics and the structural portion by the existing method in the directional coupler using a non-radiative waveguide used in the millimeter wave band.

Although the present invention has been illustrated and described with respect to exemplary embodiments thereof, the present invention should not be understood as limited to the specific embodiment, and it should be understood by those skilled in the art that the foregoing and various other changes, omission and additions may be made therein and thereto, without departing from the spirit and scope of the present invention.

What is claimed is:

1. A directional coupler using an non-radiative dielectric waveguide, comprising:

upper and lower conductive plates having conductive planes opposite to and substantially parallel to each other and;

a first NRD waveguide and a second NRD waveguide formed between said conductive plates and composed of dielectric having a predetermined permittivity; and a multiple-hole conductive plate formed between said first NRD waveguide and said second NRD waveguide, wherein the electric field component or the magnetic field component in the transmission mode of said NRD waveguides is coupled through said through hole formed in said multiple-hole conductive plate, and said multiple-hole conductive plate includes two rows of through holes.

2. The directional coupler according to claim 1, wherein said first NRD waveguide and said second NRD waveguide are hyper NRD waveguides.

3. The directional coupler according to claim 1, wherein said first NRD waveguide and said second NRD waveguide are normal NRD waveguides.

4. The directional coupler according to claim 2, wherein said upper and lower conductive plates and said multiple-hole conductive plate are perpendicular to each other.

5. The directional coupler according to claim 3, wherein said upper and lower conductive plates and said multiple-hole conductive plate are parallel to each other.

6. The directional coupler according to claim 2, wherein said upper and lower conductive plates and said multiple-hole conductive plate are perpendicular to each other.

7. The directional coupler according to claim 2, wherein said upper and lower conductive plates are said multiple-hole conductive plate are parallel to each other.

8. The directional coupler according to claim 1, wherein said through holes are circular holes.

9. The directional coupler according to claim 8, wherein the distance between the circular holes in a row is $\lambda g/4$.

10. The directional coupler according to claim 1, wherein the signal transmitted through said NRD waveguide is a millimeter wave band.

11. The directional coupler according to claim 1, wherein the coupled amount of said directional coupler is 20 dB, 10 dB, or 3 dB.

* * * * *